United States Patent [19]

Pegram et al.

[11] Patent Number: 4,572,248

[45] Date of Patent: Feb. 25, 1986

[54] WIRE SHUFFLING APPARATUS AND METHOD

[75] Inventors: Warren J. Pegram, Greensboro; Ronald G. Sergeant, Winston-Salem, both of N.C.

[73] Assignee: AMP Incorporated, Harrisburg, Pa.

[21] Appl. No.: 567,288

[22] Filed: Dec. 30, 1983

[51] Int. Cl.[4] ..... B21F 27/00

[52] U.S. Cl. ..... 140/92.1; 29/755; 140/93 R

[58] Field of Search ..... 140/92.1, 93 R; 414/16; 221/134; 29/755

[56] References Cited

U.S. PATENT DOCUMENTS 3,372,475 3/1968 Vickery .
3,804,130 4/1974 Tarbox et al. ..... 140/92.1

FOREIGN PATENT DOCUMENTS 1009831 5/1977 Canada ..... 140/92.1
63908 3/1982 European Pat. Off. .
2035872 3/1971 Fed. Rep. of Germany .
2842342 8/1979 Fed. Rep. of Germany .
1294480 4/1962 France .
2337956 8/1977 France .

*Primary Examiner*—Francis S. Husar
*Assistant Examiner*—Jerry Kearns
*Attorney, Agent, or Firm*—Robert W. J. Usher

[57] ABSTRACT

Apparatus for repositioning and adding or removing individual wires of a series of wires extending longitudinally in side-by-side relation in a row comprising a guide block formed with a cruciform slot defining a guide path and wire escapement; means to move the wires between the guide path and escapement and means to move the guide path along the row to align the escapement with a predetermined wire position in the row. In a method and apparatus for positioning wires, wires are fed from a supply through tubes having fixed wire entry ends and wire exit ends movable to vary the position of the leading ends of the wires.

9 Claims, 6 Drawing Figures

39
37
42
34
12
35
33
29
13
22
43
43
19
21
29'
15
18
16
35'
17
38
18
34'
42'
39'
10
37'
11

WIRE SHUFFLING APPARATUS AND METHOD

The invention relates to wire shuffling.

In cable or harness making operations in which a series or bunch of wires are fed longitudinally in side-by-side relation to an operating station, it is desirable to alter the position of the individual wires to obtain a cable or harness of altered configuration. In addition, it may be desired to increase or decrease the number of wires fed to the operating station by adding or removing an individual wire to obtain a cable or harness of altered size.

According to one aspect of the invention, there is provided a method of altering the relative positions of individual wires in a bunch of wires for making a wire harness comprising the steps of feeding leading ends of the individual wires into respective flexible wire-receiving tubes, retaining wire entry ends of the tubes in fixed condition and moving wire exit ends of the tubes in directions perpendicularly of the tube axes into different desired relative positions.

Suitably, the entry ends of all of the tubes are arranged in coplanar relation and the exit ends of at least some of the tubes are moved into overlapping relation.

Flexure of the tubes permits their wire exit ends to be interwoven to provide a variety of wire positions.

Conveniently, the wires may be fed through the tubes by roller nips adjacent entry or exit ends of the tubes.

A wire positioning apparatus according to the invention comprises a flexible wire-receiving tube fixed at a wire-entry end means being provided to move the other, wire-exit end of the tube, in directions perpendicularly to the tube axis thereby to alter the position of a wire portion received in that end.

The tube may comprise an imperforate metal sidewall formed with a helical cut and the invention includes a tube per se.

According to another aspect of the invention there is provided apparatus for adding a wire at a preselected position in a row of wires extending side-by-side, in parallel relation and removing a preselected wire from the row of wires comprising: means defining a guidepath for the wires extending transversely of the wires in the direction of the row; means defining an escapement for a wire extending transversely of the guidepath; means to move the wire perpendicularly of its axis between the row and the escapement; the escapement and the wire moving means being movable relatively along the row into alignment with a preselected wire position for operation of the wire moving means. Suitably, means are provided to urge the wires in the row along the guidepath closely together during operation of the wire moving means to remove a wire from the row.

The guide path may comprise the horizontal portion of a cruciform tube receiving slot in a guide block and the escapement may comprise vertical portions of the slot. A series of flexible wire-receiving tubes may be located for movement along the guidepath and between the guidepath and escapement when receiving a wire.

The abutment of the tubes may also assist in obtaining a predetermined spacing apart of the wires after repositioning.

An example of the invention will now be described with reference to the accompanying drawings in which:

FIGS. 3*a–d* are schematic views of a guide body showing a procedure to remove a wire from the row of wires.

Figure 1:
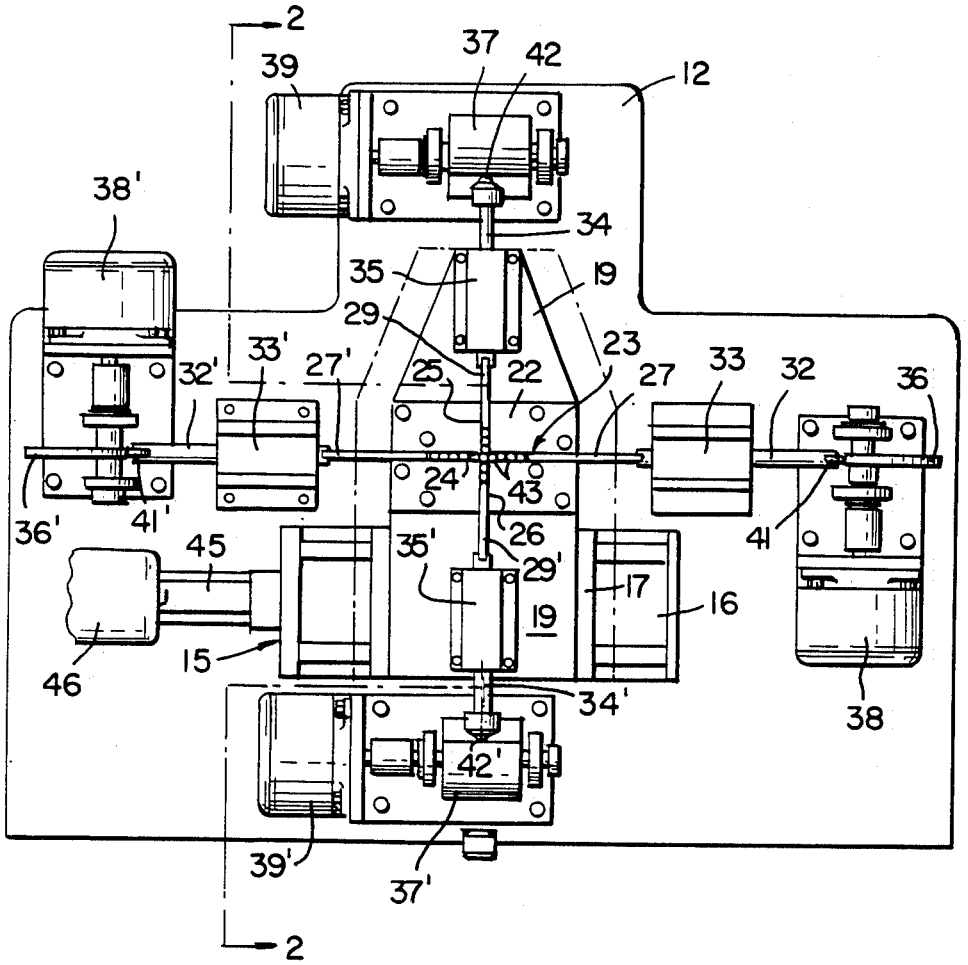
FIG. 1 is a front elevational view of wire shuffling apparatus according to the invention.
Figure 2:
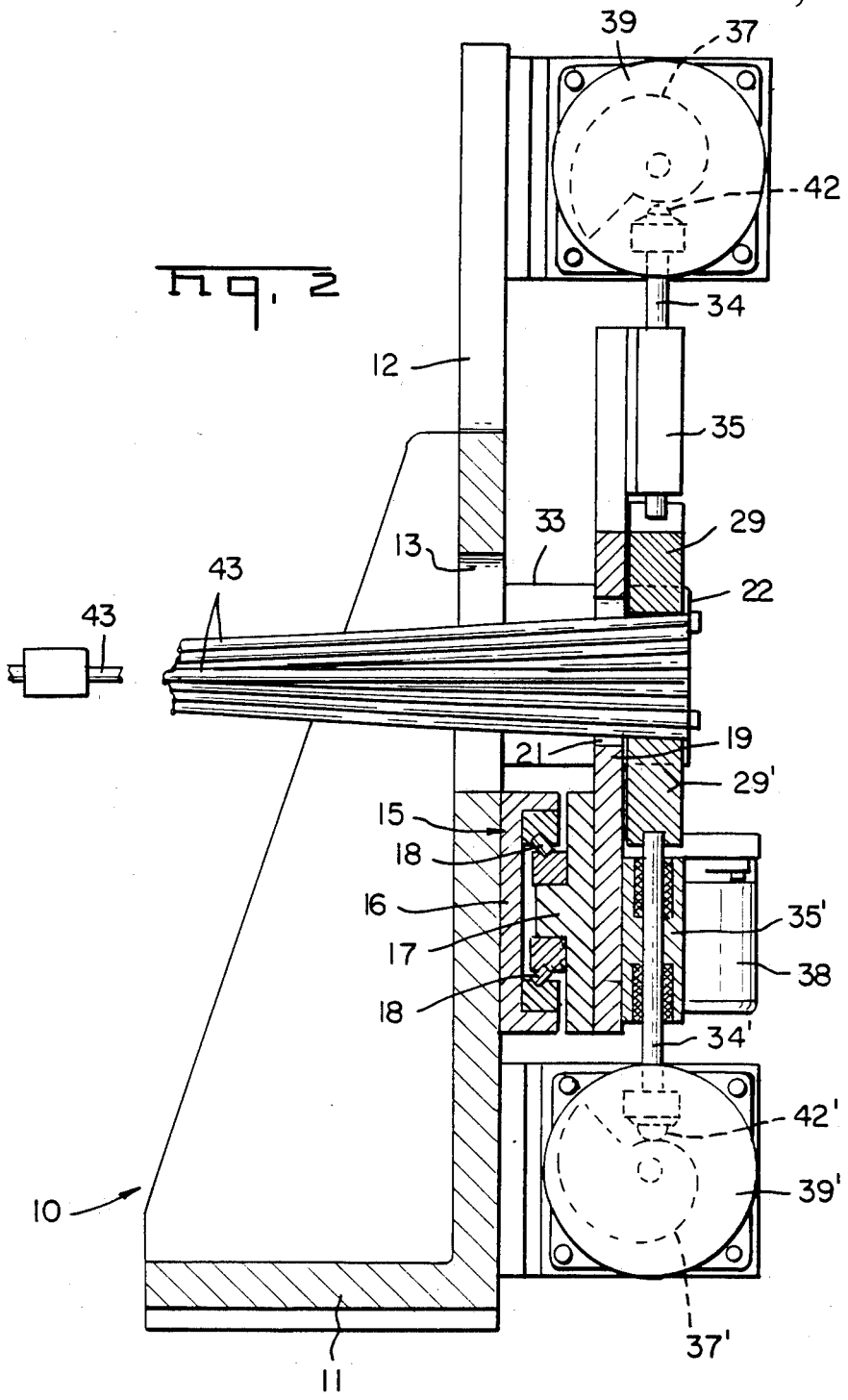
FIG. 2 is a side elevation of the apparatus partly in cross-section taken along line 2—2 of FIG. 1.
Figure 7A:
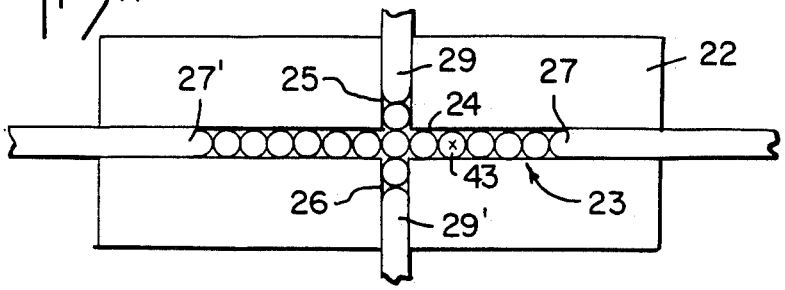
Figure 7B:
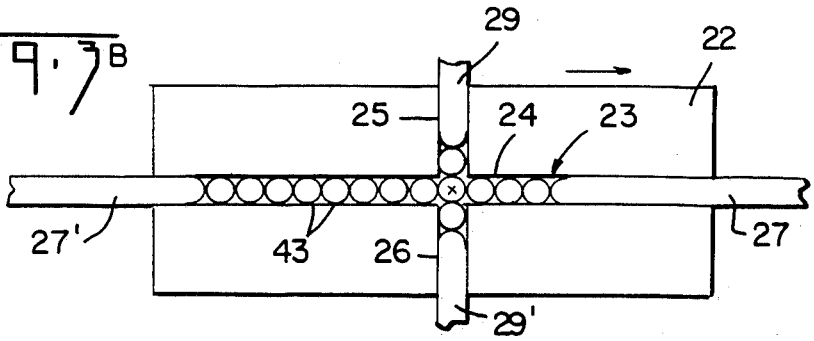
Figure 7C:
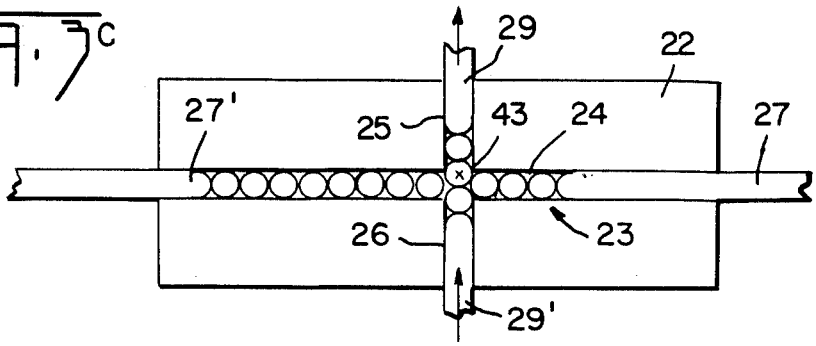
Figure 7D:
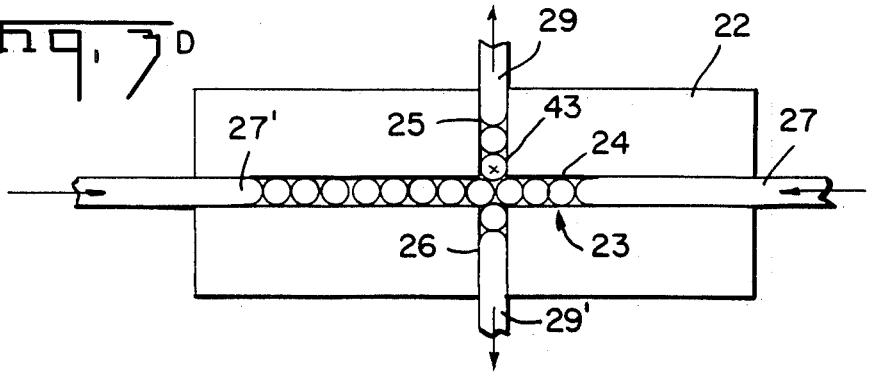

The wire shuffling apparatus comprises a frame 10 having a base 11 and an upright support plate 12 formed at a central location with a tube-receiving aperture 13. A conventional slide mechanism 15 (commercially available) is fixed to the support plate 12 below the aperture. Briefly described, the slide mechanism comprises a fixed channel section slide 16 receiving a slider 17 on bearings 18 and carrying an upright back plate 19 formed at a central location with a tube-receiving aperture 21 aligned with aperture 13. A guide block 22 formed with a cruciform slot 23 is fixed to the front of the back plate 19 with the slot aligned with the aperture 21. The slot 23 provides a horizontal guidepath 24 for wire-receiving tubes 43 intersected at upper and lower edges by escapement slots 25 and 26. Tube moving fingers 29, 29' are mounted for vertical reciprocation along upper and lower escapements 25 and 26, respectively, and tube moving fingers 27' are mounted for horizontal reciprocation along guidepath 24. The fingers 27, 27' and 29, 29' are connected by rods 32, 32' and 34, 34' slidably mounted in rod bearings 33, 33' and 35, 35', respectively, fixed to the back plate 19 operably engaging cams 36, 36' and 37, 37' driven by conventional stepping motors 38, 38' and 39, 39'. Cams 37, 37' are relatively wide to accommodate horizontal movement of the guide block 22 and back plate 19 while cams 36, 36' are relatively narrow. Accordingly, ball type cam followers 42, 42' are used with cams 37, 37' and roller type cam followers 41, 41' with cams 36, 36'. Movement of the slide 17 is effected by stepping motor 46 through 46 through arm 45.

Each tube 43 is a drawn metal tube formed with a helical cut to provide flexibility and an otherwise imperforate wall. The tubes are clamped in coplanar relation at a wire entry end and their wire exit ends are located along the guidepath 24 for movement by the fingers.

The apparatus is particularly suitable for use in cable or harness making where it is desired to feed individual wires longitudinally in a coplanar row in closely spaced relation from wire supplies (e.g., reels) to a work station; for example, a bonding station (in which the wires are bonded together at intervals along their length to form a flat cable as described in the continuation of U.S. patent application Ser. No. 361005 filed Dec. 8, 1983) and where it is desired to add or remove an individual wire at a preselected position in the row of wires.

As shown in FIGS. 3*a–d*, when it is desired to remove wire X in tube 43 from the row of wires forming the cable, the guide block 22 is moved horizontally by stepping motor 46 to move the escapements 25 and 26 along the row into alignment with the tube receiving the wire (as shown in FIG. 3*b*). During such movement, the tubes are confined together in the row by fingers 27 and 27' and unused tubes are confined in escapements 25 and 26 by fingers 29 and 29', the cam followers 42, 42' moving along the surface of cams 37 and 37', respectively. FIGS. 29 and 29' are then both moved up by the cams 37 and 37' as indicated in FIG. 37 to urge the tube with wire X partly from the row into the mouth of the escapement 25. FIGS. 29 and 29' are then withdrawn during movement together of fingers 27, 27' urging the tubes in the row together to force tube with wire X fully into escapement 25 (FIG. 3*d*). Repositioning of the entire tube row may, of course, be obtained by operation of the fingers 27, 27'.

It will be appreciated that adding a wire can be achieved by essentially reversing the removal procedure. That is by moving the guide block to align the escapements carrying the tube with the wire to be added into alignment with a desired location in the row (between adjacent tubes) withdrawing apart both fingers 27, 27' while advancing together fingers 29, 29', thereby to impel the tube into the mould of the escapement to protrude into the guide path (in a similar position to that shown in FIG. 3*c*) and subsequently moving both fingers down to complete the addition of the wire.

Movement of tubes across the guide path from one escapement to another enables any desired tube in an escapement to be added to the row.

We claim:

1. Apparatus for adding a wire at a preselected position in a row of wires extending side by side, in parallel relation and removing a preselected wire from the row of wires comprising a frame, means mounted on the frame defining a guidepath for the wires extending transversely of the wires in the direction of the row; means mounted on the frame defining an escapement for a wire extending transversely from the guidepath; opposed cooperative means in said escapement to move the wire perpendicularly of its axis from the row to the escapement and from the escapement to the row; opposed cooperative moving means in said guide path to urge the wires in a row along the guidepath closely together and to permit limited movement apart of the wires on the removal from and addition of a wire to the row, respectively; and, means mounted on the frame to move the escapement and the wire moving means relatively along the row into alignment with a preselected wire position for operation of the wire moving means.

2. Apparatus according to claim 1 in which means are provided to urge the wires in the row along the guidepath closely together during operation of the wire moving means to remove a wire from the row.

3. Apparatus according to claim 1, in which the guidepath is defined by first a slot in a guide body, the escapement comprising a second slot intersecting the first slot.

4. Apparatus according to claim 2 in which the escapement comprises a third slot intersecting the first slot at a location opposite the intersection with the second slot.

5. Apparatus according to claim 4 in which the guide body and the wire moving means are mounted for the aligning movement on a slide extending along the row.

6. Apparatus according to any one of claims 1–4 wherein said wires are located in a series of flexible wire receiving tubes located for movement along the guidepath and between the guidepath and escapement when receiving a wire.

7. Apparatus according to claim 5 in which the tubes are fixed at common, wire entry ends, their other wire exit ends being located for movement along the guidepath and escapement.

8. A method of selectively adding or removing a wire from a row of wires fed axially from a supply for making a wire harness comprising the steps of providing an escapement and guidepath; providing a plurality of flexible wirereceiving tubes having wire exit ends arranged in a row in said guidepath, movement of the wire exit ends moving the wires in the rows; feeding leading ends of the individual wires axially into respective wire entry ends of the respective flexible wire receiving tubes to form the row; moving the escapement and wire moving means to a preselected position; and retaining wire entry ends of the tubes in stationary condition and moving wire exit ends of the tube in directions transversely of the row into and out from the row into different desired relative positions, the exit ends of the wire receiving tubes in the row being moved relatively apart and together on the movement of tubes into and out from the row respectively.

9. A method of altering the relative positions of individual wires according to claim 8 in which the entry ends of all of the tubes are arranged in coplanar relation.

* * * * *